US005470094A

United States Patent [19]

Commier et al.

[11] Patent Number: 5,470,094

[45] Date of Patent: * Nov. 28, 1995

[54] SKI EQUIPPED WITH VARIABLE LENGTH ELASTIC TRANSMITTERS ON EITHER SIDE OF THE BINDING ZONE

[75] Inventors: Philippe Commier, Annecy; Axel Phelipon, Alby sur Cheran; Jacques Le Masson, Cran Gevrier, all of France

[73] Assignee: Salomon S.A., Metz-Tessy, France

[ * ] Notice: The portion of the term of this patent subsequent to Nov. 7, 2012, has been disclaimed.

[21] Appl. No.: 291,020

[22] Filed: Aug. 16, 1994

[30] Foreign Application Priority Data

Aug. 20, 1993 [FR] France ..... 93 10209

[51] Int. Cl.[6] ..... A63C 5/07

[52] U.S. Cl. ..... 280/602

[58] Field of Search ..... 280/602, 607, 280/608, 609, 610, 617, 633, 636

[56] References Cited

U.S. PATENT DOCUMENTS

| | | | |
|---|---|---|---|
| 4,696,487 | 9/1987 | Girard | 280/602 |
| 5,284,357 | 2/1994 | Tinkler | 280/602 |
| 5,326,126 | 7/1994 | Ruffinengo | 280/602 |
| 5,332,252 | 7/1994 | Le Masson et al. | 280/602 |
| 5,342,078 | 8/1994 | Stepanek et al. | 280/602 |

FOREIGN PATENT DOCUMENTS

| | | | |
|---|---|---|---|
| 327754 | 2/1976 | Austria | A63C 5/06 |
| 0510308 | 10/1992 | European Pat. Off. | A63C 5/075 |
| 0521272 | 1/1993 | European Pat. Off. | A63C 5/075 |
| 2675392 | 10/1992 | France | A63C 5/075 |
| 2694205 | 2/1994 | France | A63C 5/075 |
| 3315638 | 12/1983 | Germany | 280/602 |
| WO88/01189 | 2/1988 | WIPO | A63C 5/07 |

*Primary Examiner*—Brian L. Johnson

*Attorney, Agent, or Firm*—Sandler, Greenblum, & Bernstein

[57] ABSTRACT

An improvement to known ski shock-absorption devices is constituted by an elongate beam having an arched portion of a length (LC) between a forward contact line and a rear contact line; the central portion including a binding mounting zone. The ski includes two transmitters located in the central portion and each on either side of the mounting zone. One of the ends of each transmitter is linked to the beam by a complete connection; the other end is connected by a partial connection, free in translation along a longitudinal direction, constituted of an elastic and/or visco-elastic element that resists the longitudinal displacement of the transmitter; the portion of length ($l_{T1}$, $l_{T2}$) of each transmitter between the two connections being left free, at least in translation, with respect to the beam; the ratio ($l_{T1}$) of front transmitter over ($l_{T2}$) of rear transmitter being comprised between 1.5 and 2.5 and ($l_{T1}$+$l_{T2}$)/LC being comprised between 0.15 and 0.25.

11 Claims, 4 Drawing Sheets

1
2
3
4
5
6
7
8
20
21
60
61
62
70
71
90
91

I
I'
2
6
7
8
20
21
60
61
62
70
71
72
d1
d2
ℓT1
ℓT2
LC

SKI EQUIPPED WITH VARIABLE LENGTH ELASTIC TRANSMITTERS ON EITHER SIDE OF THE BINDING ZONE

BACKGROUND OF THE INVENTION

1. Field of the Invention

The present invention is related to an improved ski, such as an alpine ski, a cross-country ski, a monoski or a snowboard.

The body of the ski is obtained by virtue of a more or less flexible structure in a known manner.

2. Discussion of Background and Material Information

Various types of skis are already known and there exist a large number of variations thereof. These are constituted by a beam having an elongate shape whose front end is curved upwardly to constitute a shovel, the rear end also being slightly turned up to constitute the tail. Currently known skis generally have a composite structure wherein different materials are combined such that each of them can intervene optimally, with a view to distributing mechanical stresses when the ski is used. As such, the structure generally comprises peripheral protection elements, internal resistance elements so as to resist bending and torsional stresses, and a core. These elements are assembled by adhesion or by injection, the assembly generally occurring in a hot mold that has the definitive shape of the ski, with a front portion turned up substantially in a shovel, and a rear portion slightly turned up in a tail, and a central arched portion.

Currently known skis have a certain number of disadvantages, and in particular, their behavior in response to biases caused by the bendings and vibrations of the ski are inadequate. As a matter of fact, persistent vibrations cause a loss of adherence, and therefore, unsatisfactory steering of the ski.

It is thus important to provide an appropriate response that would resist such types of biases.

The commonly assigned French Patent Publication No. 2,675,392 is especially related to a shock-absorption device for a ski constituted by at least one flexible blade connected to the ski by a rigid connection and at least one flexible connection, these connections being spaced longitudinally with respect to one another on the blade.

The commonly assigned European Patent Publication No. 521,272 is related to another shock-absorption device wherein the flexible connection is replaced by a slidable friction connection.

In commonly assigned French Patent Publication No. 2,694,205, the friction connection is of a viscous type.

With respect to these aforementioned disclosures, the present invention constitutes an improvement that takes the following facts into account:

- the mass of the front portion of the ski is greater than that of the rear portion;
- the amplitude and intensity of the biases to which the forebody of the ski is subjected is greater than those borne by the afterbody;
- depending on the type of skiing undertaken (large curves or tight turns), the requirements in terms of the stability or maneuverability of the front portion and the rear portion are different.

In addition, the present invention is not limited to a vibration-absorbing device as disclosed by the prior art. Indeed, for some types of skis, certain biases at the front and/or at the rear do not necessarily call for a dissipation but, on the contrary, a non-absorbed return force so as to procure even more maneuverability. On the other hand, for some skis, a shock-absorbing response will be called for in order to increase stability and precision at high speeds.

SUMMARY OF THE INVENTION

It is thus an object of the present invention to institute an improvement in prior art skis by lending greater thought to the requirements of the skier. As such, the invention is related to a ski constituted by an elongate beam having a central arched portion of a length LC between a forward contact line and a rear contact line; a front portion turned up in a shovel and a rear portion, less turned up, in a tail; said central portion comprising a binding mounting zone corresponding to the standardized zone. The ski comprises two transmitters located in the central portion, each on either side of the binding mounting zone; one of the ends of each transmitter being connected to the beam by a complete connection; the other end of each transmitter being connected to the beam by a partial connection means, free in translation along a longitudinal direction, constituted of an elastic and/or viscous element that resists the longitudinal displacement of said transmitter; the length portion ($l_{T1}$, $l_{T2}$) of each transmitter between the two connections being left free, at least in translation, with respect to the beam; the ratio of the free length ($l_{T1}$) Of the front transmitter over the free length ($l_{T2}$) of the rear transmitter being comprised between 1.5 and 2.5 and the ratio ($l_{T1}+l_{T2}$) over LC being comprised between 0.15 and 0.25.

Due to the fact that the ski is equipped with transmitters, in the selected length ratios, on either side of the mounting zone, a dynamic control of the deformation of the front portion and the rear portion of the ski is enabled and, as such, a perfect balance and stability of the assembly.

In order to be efficient, each transmitter should cover an "active" zone of the ski, i.e., the zone between the contact line (forward or rear) and the mounting zone that corresponds to the free portion in contact with the snow.

The role of each transmitter is to resist biases that cause the loss of adhesion of each "active" portion from the snow surface either by a shock-absorbing effect and/or by an elastic return effect as the case may be.

In order to be efficient, the transmitter covering length should be adequate but also adapted to each type of use. For this, the ratio ($l_{T1}+l_{T2}$)/LC should be comprised within the previously defined limits.

According to another characteristic of the invention, the end of each transmitter connected by a complete connection is located on the side directed towards the front or rear portion, the other end being located on the side in the direction of the mounting zone. Due to this fact, the substantial amplitude biases at the ends are captured by the fixed end of the stiffener, transmitted by the free end, then "processed" at the end of the transmitter that is provided with the partial connection means of the elastic and/or visco-elastic type in an area that is close to the area where the weight of the skier is distributed, and thus more stable.

According to another important characteristic, the distance (d1) separating the front end of the front transmitter from the forward contact line is comprised between 0.18 LC and 0.25 LC.

Similarly, the distance (d2) separating the rear end of the rear transmitter from the rear contact line is comprised between 0.16 LC and 0.21 LC.

Both these characteristics define the affixation zone of the transmitter in each free portion of the ski with respect to each contact line. If the transmitters are brought too close to the contact line, the result can be detrimental because the steering of the ski then becomes too controlled. The ski exhibits poor maneuverability and the skier has to exert more force in order to take turns. Conversely, if there is too much distancing from the fixed point of the transmitter with respect to the contact line, it results in inverse the detrimental effect. The ski is less "driven", i e. it loses stability at high speeds and the skier experiences difficulty in maintaining the envisioned trajectory of the ski. However, if a shock absorption effect is desired, the further the fixed point is from the contact line, the weaker such effect.

In particular, for a ski of the "special" slalom type, it would be desirable that distance (d1) (at least) be close to its upper limit.

On the other hand, for a ski of the "giant" slalom type, it would be desirable that distance (d1) (at least) be close to its lower limit.

According to another complementary characteristic, under bending stress, the displacement (Δ1) of the rear end of the front transmitter with respect to the beam is greater than the displacement (Δ2) of the front end of the rear transmitter; such that the ratio (Δ1/Δ2) is comprised between 1.2 and 2.5.

According to another advantageous characteristic, the stiffness K1 of the elastic and/or viscous means of the front transmitter is greater than the stiffness K2 of the elastic and/or viscous means of the rear transmitter such that the ratio K1/K2 is comprised between 1.2 and 5.

The partial connection means can be constituted by different means, depending on the effect desired.

The choice of such means is non-limiting, but the following selections may be advantageously provided.

The partial connection means is constituted by an interface layer made of an elastic or visco-elastic material connecting, at least, the lower surface of the end of each transmitter above the beam so as to work in response to shearing by the longitudinal displacement of said end with respect to the beam. The advantage of selecting this alternative lies in the fact that the device does not become cumbersome, and its height is especially limited with respect to the beam of the ski. Furthermore, it is extremely simple to implement, as well as economical and functionally reliable. The visco-elastic properties of the material forming the interface enable the energy transmitted by the device to be dissipated.

The partial connection means can also be constituted by a spring/abutment assembly working in response to compression. This system, contrary to the previous one, does not dissipate the energy transmitted, but brings an elastic response that tends to resist the deformation of the front or rear portion of the ski.

According to another solution, the spring can be replaced by an elastic or visco-elastic pad.

Finally, the elastic or visco-elastic pad or spring assembly can also be provided to work in response to traction.

BRIEF DESCRIPTION OF THE DRAWINGS

Other characteristics and advantages of the invention will become apparent from the description that follows with reference to the annexed drawings that are provided only as non-limiting examples thereof.

FIG. 9 shows a detail of FIG. 5 as per a further variation.

DETAILED DESCRIPTION OF THE PREFERRED EMBODIMENTS

Figure 1:
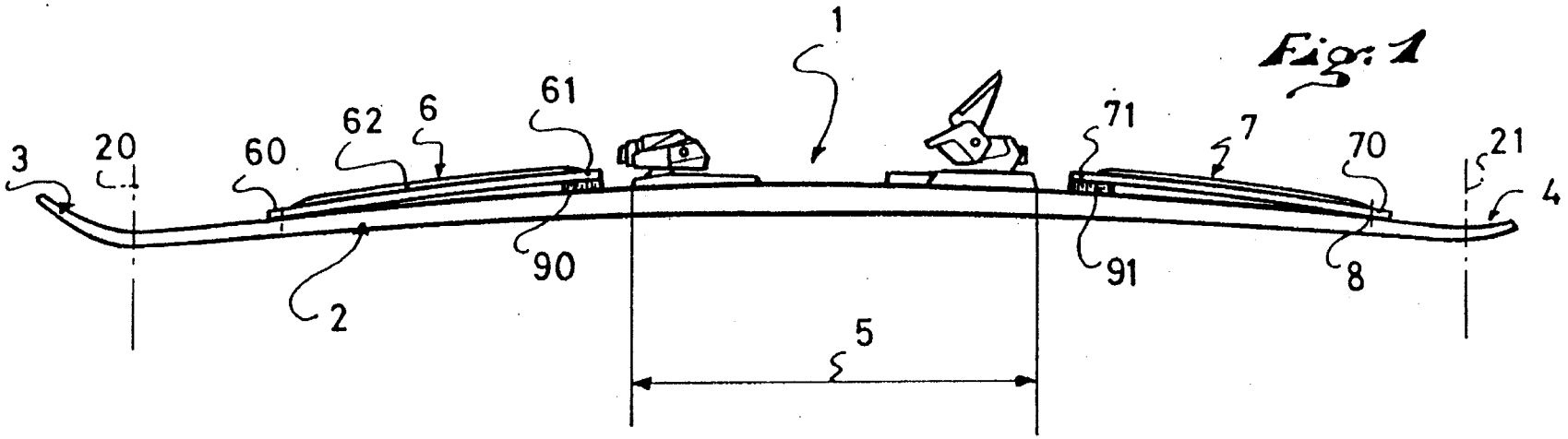
FIG. 1 is a longitudinal view of a ski as per the invention.

The ski as per the invention comprises an elongate beam 1 having its own distribution of thickness, width, and thus, its own stiffness.

The beam can be divided into several distinct portions; a central arched portion 2 of a length LC demarcated by a forward contact line 20 and a rear contact line 21. When the ski is at rest, i.e., when it is not loaded with the mass of the skier, the ski rests along its two contact lines 20, 21. When the ski has a load, the contact between the lower surface of the ski and the snow takes place between the contact lines 20, 21 along a surface of length LC, since the camber of the ski is eliminated. The beam also comprises a front shovel portion 3 beyond forward contact line 20. This portion is turned up substantially, in a known manner. A less turned up tail portion 4 extends beyond rear contact line 21.

The central portion 2 comprises a binding mounting zone 5 corresponding to the so-called "standardized" zone. In the case of alpine skis, the standardized zone is defined by the norm ISO 8364. In cross-country skis, the norm is DIN-ISO 9119. Finally, in the field of snowboards, the norm is being formulated at this time (ISO 10958).

Figure 2:
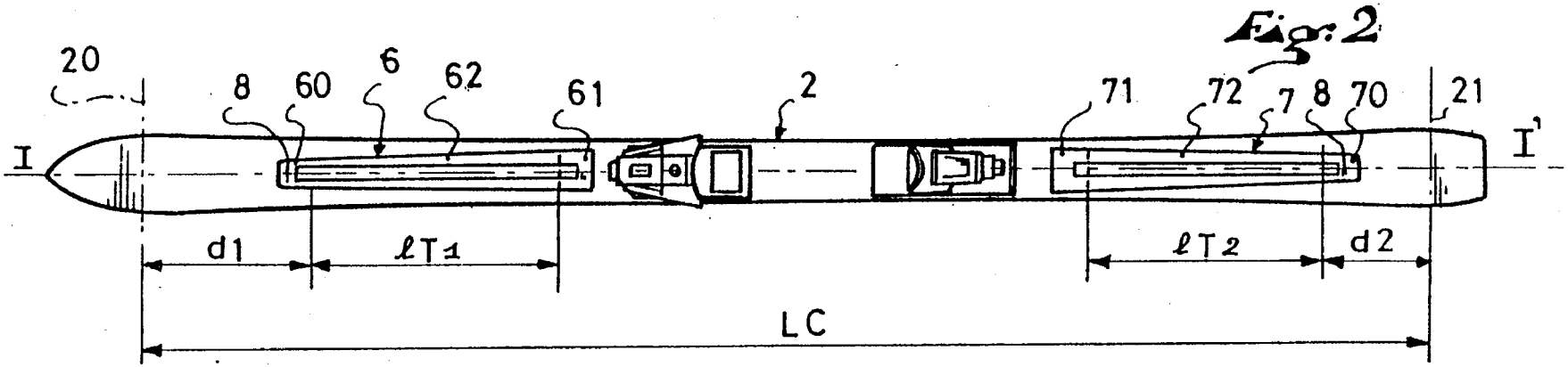
FIG. 2 is a top view of the ski of FIG. 1.

In FIGS. 1 and 2, beam 1 of the ski is overlaid, in its central portion 2 and on either side of mounting zone 5 by two transmitters 6, 7. The term transmitter denotes any elongate element, relatively flexible so as not to locally contribute an excess of stiffness, but that can adequately resist buckling, in order to fulfill its function of transmitting biases from one end to the other. The buckling resisting function can be partially fulfilled by additional guiding means in the free portion of the transmitter, of the slide, stirrup type, etc.

The transmitter can be constituted by a blade, a strip or even a ring. Thus, it may be advantageous to construct a strip (having an evolving section) whose central portion comprises an inverted U-shaped section to increase its resistance to buckling and whose ends are planar to facilitate its affixation to the ski.

The constituent material of the transmitter can be selected from among plastic materials, composite materials, and metals, for example.

Each transmitter is arranged along the direction of the longitudinal axis of the ski. The end 60, 70 of each transmitter located on the side in the direction of the contact lines 20, 21 is rigidly affixed to the beam by a complete connection 8.

The expression complete connection denotes a connection that prohibits any degree of freedom to end 60, 70 with respect to the beam. It can be a connection by screwing, adhesion, or even welding. When the materials forming the top of the beam and those forming the transmitters are compatible with one another, it would be preferable to link the transmitter to the beam by using the vibration welding method.

The other end 61, 71 of each transmitter is connected to the beam by a partial connection, free in translation along the longitudinal direction l, l' of the ski. The expression partial connection denotes a connection allowing some degree of freedom. In the case of the present invention, the choice of the direction of this degree of freedom follows the direction of axis l, l'.

Each partial connection means is constituted of an interface layer 90, 91 made of an elastic or visco-elastic material, at least connecting the lower surface of end 61, 71 of each transmitter above the beam of the ski.

The hardness of an elastic material used can vary between Shore A 10 to 85. For a visco-elastic material, the hardness varies from Shore A 50 to 95 for an elasticity module comprised between 15 and 160 MPa and a shock absorption value of 0.13 to 0.72. Naturally, these data are only provided as embodiment examples for a temperature of 20 degrees Celsius and a frequency of 15 Hertz.

The material constituting the interface is selected from among rubber and thermoplastic elastomers.

The affixation of the interface on the transmitter and the top of the beam is done either by a thermohardenable resin of the epoxy, polyester, vinylester or polyurethane type, or by a thermoplastic film, or by any other means.

Each transmitter 6, 7 therefore comprises a free portion 62, 72 between their connected ends 60, 61, 70, 71. In the invention, length $l_{T1}$ of the free portion of front transmitter 6 is greater than the length $l_{T2}$ of the free portion of the rear transmitter; the ratio $l_{T1}/l_{T2}$ being more specifically comprised between 1.5 and 2.5.

In addition, the ratio $(l_{T1}/l_{T2})/LC$ is comprised between 0.15 and 0.25.

The ratio $l_{T1}/l_{T2}$ characterizes the front/rear operational balance of the ski when it is in use. The ratio $(l_{T1}+l_{T2})/LC$ characterizes the front/rear efficiency of the device.

Preferably, for a ski of the "giant" type, the ratio $l_{T1}/l_{T2}$ is comprised between 2.2 and 2.5 and $(l_{T1}+l_{T2})/LC$ is comprised between 0.2 and 0.25.

Preferably, for a ski of the "slalom" type, the ratio $l_{T1}/l_{T2}$ is comprised between 1.5 and 1.75 and $(l_{T1}+l_{T2})/LC$ is comprised between 0.15 and 0.2.

Advantageously, fixed end 60, 70 of each transmitter ought to be located close to its respective contact line 20, 21; however, at a certain distance (d1, d2) thereof.

More specifically, the distance d1 separating front end 60 of front transmitter 6 from the forward contact line 20 should be comprised between 0.18 LC and 0.25 LC. The distance d2 separating rear end 70 from the rear contact line 21 should be comprised between 0.16 LC and 0.21 LC. If these ranges are not respected, the ski operates unsatisfactorily, which is translated by a tendency to under turn (in the sense that greater force is required to shorten the radius of curvature in a turn), when d1 and d2 are less than the characterized ranges, and by a tendency to lose stability and precision of the ends (shovel/tail) when d1 and d2 are greater than the characterized ranges; all other parameters being, however, identical.

Preferably, for a ski of the "giant" type, d1 should be comprised between 0.18 and 0.2 and for a ski of the "slalom" type, d1 should be comprised between 0.2 and 0.25 (the influence of d2 has less impact on the behavior of the ski depending on which type it is).

As illustrated in FIG. 2, d1 more specifically represents the distance between the forward contact line 20 and the line separating the fixed end 8 from the free portion 62. Similarly for d2: it is the distance between the rear contact line 21 and the line separating the fixed end 8 from the free end 72.

Figure 3:
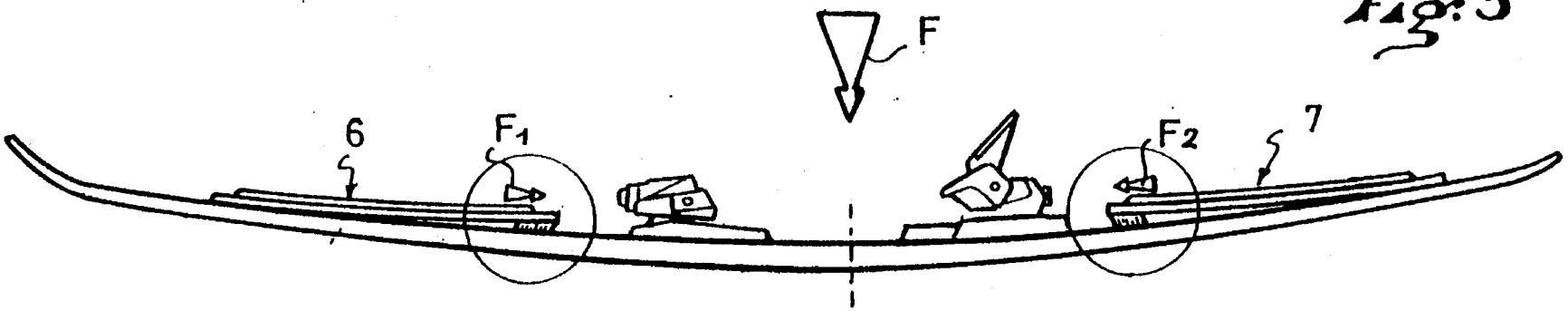
FIG. 3 is a view of the ski of FIGS. 1 and 2 in the bent position.
Figure 3B:
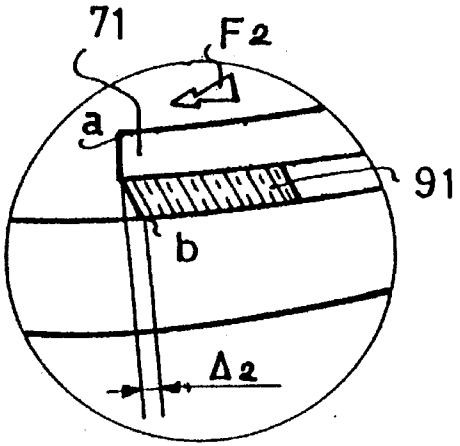
FIG. 3*b* shows a detail of the rear end of the rear transmitter, on a larger scale.
Figure 3A:
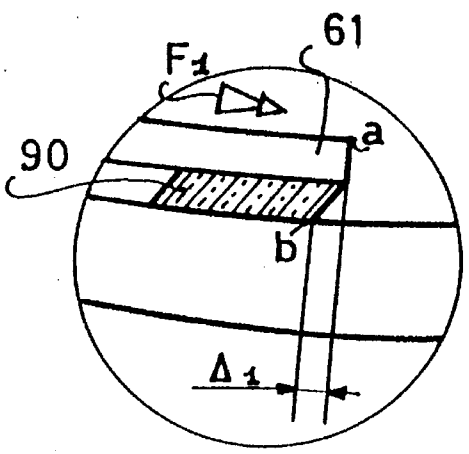
FIG. 3*a* shows a detail of the front end of the front transmitter, on a larger scale.

FIGS. 3, 3*a* and 3*b* schematically represent the functioning of the invention. FIG. 3 shows the ski while bending, when a force F is applied at the center of the beam. In dynamic situations, it is understood that a similar symmetrical bias is not the only one encountered. More generally, the front and rear portions of the ski are biased differently at different moments. The test of FIG. 3 is obtained as per the procedure for determining the overall spring constant of a ski according to norm ISO 5902. The point of application of the force F is in the middle of LC. While bending, it can be noted that there is a relative rearward displacement of rear end 61 of front transmitter 6 and simultaneously, a frontward displacement of front end 71 of rear transmitter 7. As shown in the drawings (see FIGS. 3, 3*a*, 3*b*), the mobile ends 61, 71 were respectively displaced, by $\Delta 1$ and $\Delta 2$, and such displacements were braked due to the shearing caused by the interface layers 90, 91.

As regards the bending test illustrated, $\Delta 1$ is always greater than $\Delta 2$ and the ratio $\Delta 1/\Delta 2$ should be advantageously comprised between 1.5 and 2.5.

Figure 4:
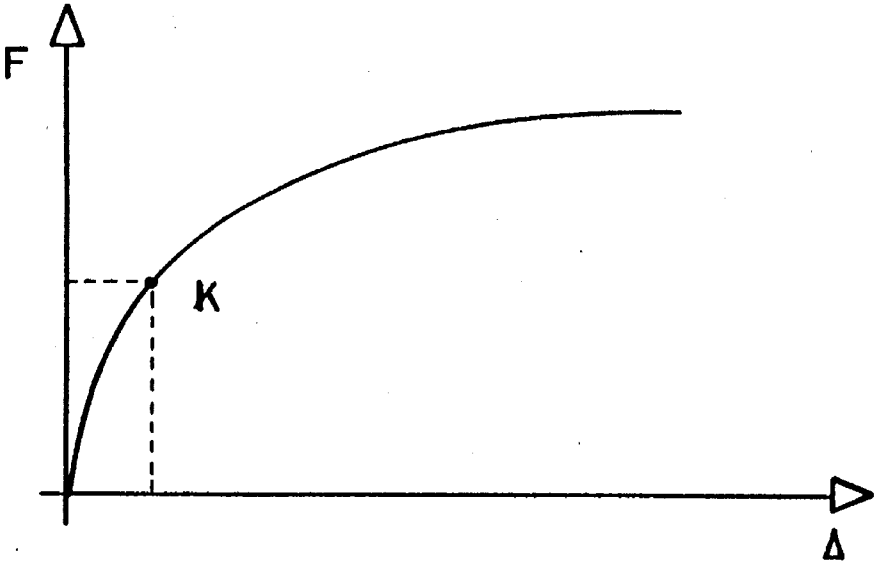
FIG. 4 is an example of curve F=f(Δ) for a material of the visco-elastic type.
Figure 5:
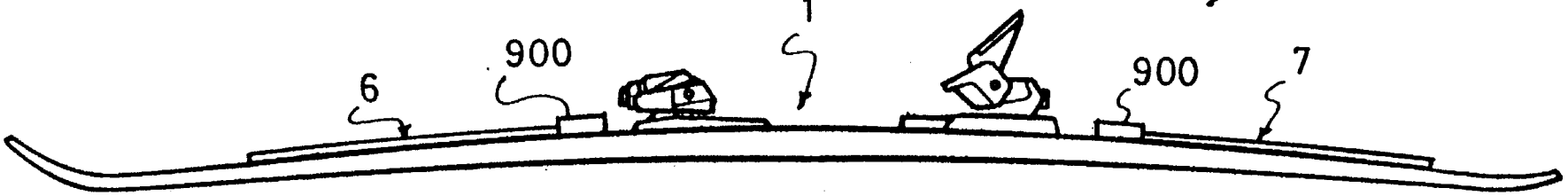
FIG. 5 illustrates a variation of FIG. 1.

Depending on the nature of the elastic or visco-elastic element used, one can define a variable stiffness K1 and K2 for each, equal respectively, to the ratio $F1/\Delta 1$ and $F2/\Delta 2$ for a displacement speed of 20 mm/mn and a temperature of 20° Celsius. Generally speaking, for a material of the visco-elastic type, the speed of the curve $F1=f(\Delta)$ is provided in FIG. 4. K represents the curve tangent value at any point.

In the test of FIG. 3, within the procedures of norm ISO 5902, the ratio K1/K2 should be comprised between 1.2 and 5. This ratio characterizes the processing efficiency of the energy transmitted by the transmitter. In other words, comparatively, more energy is either dissipated or restituted at the forebody than at the afterbody of the ski due to the fact that the energy transmitted by the front transmitter is greater than the energy transmitted by the rear transmitter.

The invention is not limited to the embodiment illustrated in FIGS. 1 to 3 which are related to an example using an elastic or visco-elastic element in the form of an interface layer working in response to shearing.

It can also be arranged that the partial connection means be constituted by an assembly such as illustrated in FIGS. 5 to 9.

Figure 6:
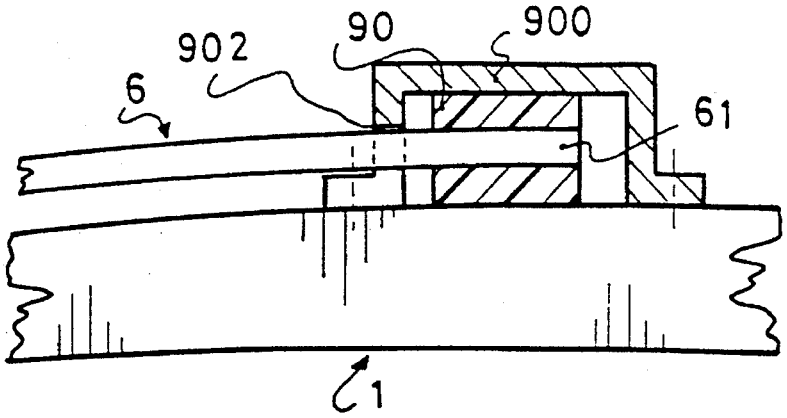
FIG. 6 shows a detail of FIG. 5.

In FIG. 6, end 61 of transmitter 6 is covered by a protective element constituting a cap 900 in order to enable the surface of the interface layer working in response to shearing to be increased. Thus, the upper surface of end 61 of the transmitter is connected to the inner surface of the cap 900 by a second interface layer 90. Front opening 902 of element 900 enables passage and participates in guiding the transmitter. The edges of cap 900 are fixedly connected above beam 1 by any means, such as screwing, welding, adhesion, etc. An identical system equips rear transmitter 7.

Figure 7:
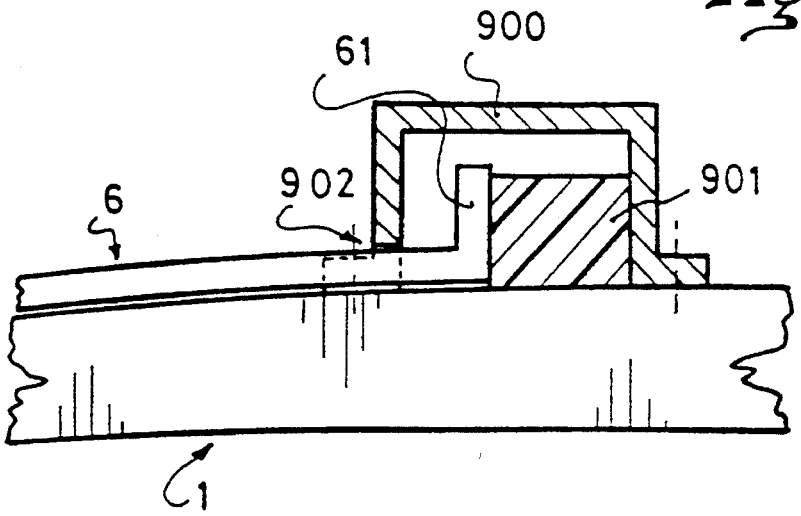
FIG. 7 shows a detail of FIG. 5 as per a variation.
Figure 8:
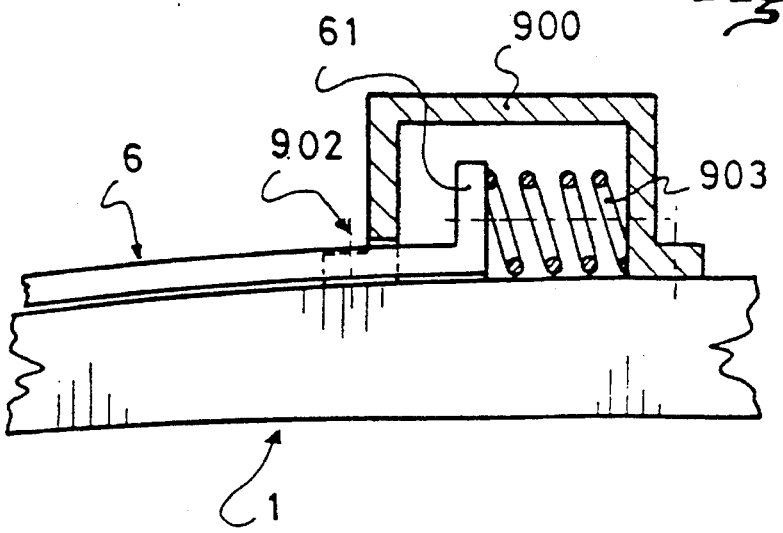
FIG. 8 shows a detail of FIG. 5 as per another variation.

FIGS. 7 and 8 especially illustrate the compressible assemblies that act as the partial connection means.

In FIG. 7, for example, end 61 of transmitter 6 acts on an elastic or visco-elastic pad 901 which is compressed against the transverse wall of a protective element 900 acting as an abutment.

In the example of FIG. 8, the elastic element is constituted by a spring 903 that replaces elastic pad 901 of the example of FIG. 6.

Naturally, the invention is not limited to the embodiments described and represented as examples hereinabove, but also comprises all technical equivalents and combinations thereof. This is true, in particular, for equivalents capable of replacing the connection means of the transmitter. Indeed, one could also provide a partial connection means constituted by an assembly comprising a spring or an elastic pad connected to the beam and to the end of the transmitter in such a way that it can be tractionally biased, without leaving the scope of the invention. Similarly, as shown in FIG. 9, the partial connection means could be a hydraulic absorber constituted by a sealed chamber 900 connected to the beam or transmitter 6 and containing a viscous fluid 905. Finally, the arrangement of the partial connection means can also be done serially (viscous/elastic) for example.

The dimensional characteristics by type of ski have been collated in the following table, as an example:

| CHARACTERISTICS TYPE | LC (mm) | $l_{T1}$ (mm) | $l_{T2}$ (mm) | d1 (mm) | d2 (mm) | $l_{T1}/l_{T2}$ | $l_{T1}+l_{T2}$ / LC | d1 / LC | d2 / LC |
|---|---|---|---|---|---|---|---|---|---|
| GIANT | | | | | | | | | |
| Large Size (GT) | 1805 | 302 | 132 | 358.5 | 368.5 | 2.29 | 0.24 | 0.2 | 0.2 |
| Small Size (PT) | 1555 | 222 | 92 | 301.5 | 295.5 | 2.41 | 0.2 | 0.19 | 0.19 |
| INTERMEDIATE | | | | | | | | | |
| GT | 1775 | 262 | 132 | 382 | 355 | 1.98 | 0.22 | 0.22 | 0.2 |
| PT | 1525 | 182 | 92 | 325 | 282 | 1.98 | 0.18 | 0.21 | 0.19 |
| SLALOM | | | | | | | | | |
| GT | 1755 | 222 | 132 | 411 | 346 | 1.68 | 0.2 | 0.23 | 0.2 |
| PT | 1505 | 142 | 92 | 354 | 273 | 1.54 | 0.15 | 0.24 | 0.18 |

Finally, although the invention has been described with reference of particular means, materials and embodiments, it is to be understood that the invention is not limited to the particulars disclosed and extends to all equivalents within the scope of the claims.

What is claimed:

1. A ski comprising:

an elongate beam having a central arched portion of a predeterminate length (LC) between a forward contact line and a rear contact line, an upwardly turned front portion comprising a shovel and a less turned up rear portion comprising a tail, said central portion comprising a binding mounting zone corresponding to a standardized zone, two transmitters located in said central portion and each on either side of said binding mounting zone; one of the ends of each transmitter being connected to the beam by a complete connection; the other end of each transmitter being connected to the beam by a partial connection means, free in translation along a longitudinal direction, the partial connection comprising one of an elastic and viscous element that resists the longitudinal displacement of said transmitter; a portion of a length ($l_{T1}$, $l_{T2}$) of each transmitter between the two connections being left free at least in translation with respect to the beam; the ratio of the free length ($l_{T1}$) of a front transmitter over the free length ($l_{T2}$) of a rear transmitter being comprised between 1.5 and 2.5, and the ratio ($l_{T1}+l_{T2}$) over a ski length (LC) being, comprised between 0.15 and 0.25.

2. A ski according to claim 1, wherein the end of each transmitter, that is connected by a complete connection, is located on the side in the direction of the forward or rear portion; the other end being located on the side in the direction of the mounting zone.

3. A ski according to claim 2, wherein the distance (d1) separating the front end of a front transmitter from the forward contact line is comprised between 0.18 LC and 0.25 LC.

4. A ski according to claim 2, wherein the distance (d2) separating the rear end of a rear transmitter from the rear contact line is comprised between 0.16 (LC) and 0.21 (LC).

5. A ski according to claim 1, wherein, under bending stress, the displacement (Δ1) of rear end of a front transmitter with respect to beam is greater than the displacement (Δ2) of the front end of a rear transmitter; such that the ratio (Δ1/Δ2) is comprised between 1.2 and 2.5.

6. A ski according to claim 5, wherein the stiffness (K1) of one of the elastic and viscous element of the front transmitter is greater than the stiffness (K2) of one of the elastic and viscous element of the rear transmitter; such that the ratio (K1/K2) is comprised between 1.2 and 5.

7. A ski according to claim 1, wherein the partial connection means is constituted by an interface layer made of one of an elastic and a visco-elastic material at least connecting the lower surface of an end of each transmitter above the beam so as to work in response to shearing by the longitudinal displacement of said end with respect to the beam.

8. A ski according to claim 1, wherein the partial connection means comprises an abutment affixed to the beam and a compression spring interposed between the beam and the partially connected end of a respective transmitter.

9. A ski according to claims 1, wherein the partial connection means comprises an abutment affixed to the beam and a compressible pad interposed between the beam and the partially connected end of a respective transmitter.

10. A ski according to claim 1, wherein the partial connection means comprises a spring or elastic pad assembly working in response to traction and connected to the beam.

11. A ski according to claim 1, wherein the partial connection means comprises a hydraulic absorber including a sealed chamber connected to the beam and containing a viscous fluid.

* * * * *

UNITED STATES PATENT AND TRADEMARK OFFICE

CERTIFICATE OF CORRECTION

PATENT NO. : 5,470,094
DATED : November 28, 1995
INVENTOR(S) : Philippe COMMIER et al.

It is certified that error appears in the above-indentified patent and that said Letters Patent is hereby corrected as shown below:

On the cover sheet, item [*] of the patent should be printed as follows:

-- Notice: The portion of the term of this patent subsequent to August 16, 2014, has been disclaimed. --

Signed and Sealed this

Thirtieth Day of July, 1996

*Attest:*

*Attesting Officer*

BRUCE LEHMAN

*Commissioner of Patents and Trademarks*